US010604288B2

(12) United States Patent
Mulder

(10) Patent No.: US 10,604,288 B2
(45) Date of Patent: Mar. 31, 2020

(54) PACKAGING APPARATUS

(71) Applicant: OMORI MACHINERY CO., LTD, Saitama (JP)

(72) Inventor: Jeroen Herman Hubertus Mulder, Enschede (NL)

(73) Assignee: OMORI MACHINERY CO., LTD, Saitama (JP)

( * ) Notice: Subject to any disclaimer, the term of this patent is extended or adjusted under 35 U.S.C. 154(b) by 363 days.

(21) Appl. No.: 15/567,864

(22) PCT Filed: Apr. 20, 2016

(86) PCT No.: PCT/JP2016/062510

§ 371 (c)(1),
(2) Date: Oct. 19, 2017

(87) PCT Pub. No.: WO2016/171167

PCT Pub. Date: Oct. 27, 2016

(65) Prior Publication Data

US 2018/0118390 A1 May 3, 2018

(30) Foreign Application Priority Data

Apr. 20, 2015 (JP) ..... 2015-085986

(51) Int. Cl.
*B65B 31/04* (2006.01)
*B65B 9/06* (2012.01)
(Continued)

(52) U.S. Cl.
CPC ..... *B65B 31/04* (2013.01); *B65B 9/00* (2013.01); *B65B 9/06* (2013.01); *B65B 31/044* (2013.01);
(Continued)

(58) Field of Classification Search
CPC ..... B65B 31/04; B65B 31/044; B65B 41/12
(Continued)

(56) References Cited

U.S. PATENT DOCUMENTS 3,664,086 A * 5/1972 James ..... B65B 9/20 53/511
3,701,229 A * 10/1972 Zelnick ..... B65B 11/52 53/427
(Continued)

FOREIGN PATENT DOCUMENTS

EP 1456083 A1 9/2004
JP S63203522 A 8/1988
(Continued)

OTHER PUBLICATIONS

Extended Search Report issued in European Application No. 16783188.2, dated Oct. 5, 2018 (5 pages).
(Continued)

*Primary Examiner* — Gloria R Weeks
(74) *Attorney, Agent, or Firm* — Osha Liang LLP

(57) ABSTRACT

[Technical Problem] A distance of a front free end portion of the gas nozzle being weighed down due to its own weight is alleviated or eliminated to suppress contact between the gas nozzle and a product.
[Solution to Problem] The present invention provides a packaging apparatus equipped with gas replacement function. In the packaging apparatus, a gas nozzle 43 is inserted into a tubular film 20, and inert gas is ejected from the gas nozzle, thereby replacing the gas inside the tubular film with the inert gas. After gas replacement, a top sealing device 30 seals and cuts the tubular film to form a packaged body. The gas nozzle is formed of magnetic material. A permanent magnet 35 is disposed inside an endless belt 34 of an upper holding belt device 28. The gas nozzle formed of magnet material is drawn to be raised due to magnetic force of the
(Continued)

permanent magnet. Due to this contact between the gas nozzle and a product is suppressed.

8 Claims, 4 Drawing Sheets

(51) Int. Cl.

| | |
|---|---|
| ***B65B 65/00*** | (2006.01) |
| ***B65B 41/12*** | (2006.01) |
| ***B65B 9/00*** | (2006.01) |
| *B65B 65/06* | (2006.01) |
| *B65B 35/24* | (2006.01) |

(52) U.S. Cl.
CPC ..... *B65B 41/12* (2013.01); *B65B 65/00* (2013.01); *B65B 35/24* (2013.01); *B65B 65/06* (2013.01)

(58) Field of Classification Search
USPC ..... 53/510, 111 R, 116, 203, 389.1
See application file for complete search history.

(56) References Cited

U.S. PATENT DOCUMENTS 3,774,367 A * 11/1973 Lerner ..... B65B 57/04 53/67
4,662,148 A * 5/1987 Nilsson ..... B65B 11/10 53/228
5,182,894 A * 2/1993 Bate ..... B65B 11/008 53/399
5,203,137 A * 4/1993 Tsukada ..... B29C 65/02 53/204
5,240,111 A * 8/1993 Yamashita ..... B65D 33/01 206/497
5,457,939 A * 10/1995 Bardou ..... B65B 55/027 426/403
7,076,930 B2 * 7/2006 Rimondi ..... B65B 9/073 53/433
7,308,780 B2 * 12/2007 Rimondi ..... B29C 65/10 53/373.8
7,823,366 B2 * 11/2010 Schoeneck ..... B23K 26/0648 53/442
7,891,157 B2 * 2/2011 Elsperger ..... B65B 53/066 53/442
2008/0092494 A1 * 4/2008 VanderTuin ..... B65B 53/063 53/557

FOREIGN PATENT DOCUMENTS

| | | | |
|---|---|---|---|
| JP | H05-254521 | A | 10/1993 |
| JP | H06-127510 | A | 5/1994 |
| JP | 2003-26117 | A | 1/2003 |
| JP | 2004-269020 | A | 9/2004 |
| JP | 2009-091034 | A | 4/2009 |

OTHER PUBLICATIONS

International Search Report of the International Searching Authority issued in PCT/JP2016/062510 dated Jun. 7, 2016 (1 page).
Written Opinion of the International Searching Authority issued in PCT/JP2016/062510 dated Jun. 7, 2016 (3 pages).

* cited by examiner

PACKAGING APPARATUS

TECHNICAL FIELD

The present invention relates to a packaging apparatus, and in particular a packing apparatus provided with a gas nozzle for filling gas in a packaged body.

BACKGROUND ART

A pillow packaging apparatus, one type of a packaging apparatus has the following configuration. The pillow packaging apparatus continuously supplies a belt-like film wound around an original film roll into a bag-making device where the belt-like film undergoes to bag-making process. Furthermore, a center sealing device arranged downstream of the bag-making device seals the overlapping edges of the bag-shaped (i.e., tubular) film having undergone the bag-making process. As a result, a tubular film is obtained. In addition, a transporting and feeding device is arranged upstream of the bag-making device, and is configured to supply a product having been transported at a predetermined interval from the transporting and feeding device into the bag-making device. Due to the afore-mentioned configuration, upon passing the bag-making device, the product is received within the tubular film at a predetermined interval, and transported together with the tubular film. A top sealing device which is arranged adjacent to an outlet of the pillow packaging apparatus cuts and seals the tubular film such that the tubular film is laterally traversed at a predetermined interval, thereby obtaining a packaged body in which the product is enclosed or contained.

However, in a case where the product to be packaged is, for example, a food such as a steamed bread or a sweet, in terms of good keeping the packaged body may be filled with inert gas. FIG. 1 shows an exemplary packaging apparatus having a function of filling inert gas. The packaging apparatus as shown in FIG. 1 is a pillow packaging apparatus, and is provided with a gas nozzle 3 for ejecting gas into a tubular film 2, the shape of which is formed by a bag-making device 1. The gas nozzle 3 is inserted into the tubular film 2. A tip or front end portion of the gas nozzle 3 is disposed adjacent to a top sealing device 4, which seals and cuts the tubular film 2. Furthermore, a rear end portion of the gas nozzle 3 is connected to a gas generating device 5. Inert gas generated by the gas generating device 5 is ejected and supplied into the tubular film 2 through the gas nozzle 3.

As such, air existing inside the front end portion of the tubular film 2 adjacent to the top sealing device 4 is pushed out upstream of the tubular film 2, and is replaced with the inert gas ejected through the gas nozzle 3. The tubular film 2 is sealed and cut by the top sealing device 4 with the front end portion of the tubular film 2 filled with the inert gas. As a result, a packaged body 6 filled with the inert gas therein is produced. The afore-mentioned packaging apparatus is disclosed in, for example, Patent Document 1.

CITATION LIST

Patent Document

[Patent Document 1] JP S63-203522 (A)

SUMMARY OF INVENTION

Technical Problem

The afore-mentioned packaging apparatus provide with the conventional gas nozzle has the following problems or drawbacks. As the tip or front end portion of the gas nozzle 3 is inserted into the tubular film 2, the tip or front end portion is made free and the other end is supported or fixed. For the reasons, as the length of the gas nozzle 3 increases, it is more weighed down with its own weight, as shown in FIG. 1. In this case, a chance that the front end portion of the gas nozzle 3 contacts the product increases. Furthermore, the greater the distance of being weighed down is, the greater force of holding down the product is. As a result, a smooth transportation of the product is inhibited, and the product is relatively displaced within the tubular film 2. In this case, there is a risk that the product may be teared and thus damaged by the top sealing device 4.

In order to avoid the above situation, there has been proposed that a dimension (size) and shape of the inner periphery of the tubular film is increased to put a greater margin or flexibility between the product and the inner periphery of the tubular film. In the case of the above configuration, even if the front end portion of the gas nozzle 3 is weighed down due to its own weight, it can be prevented from contacting the product. However, a packaging apparatus adopting the afore-mentioned configuration produces a packaged body, size of which increases relative to the product. The size increase is generally undesired. In particular, the smaller the product is, the more notable the above problem is.

Furthermore, there has been also proposed that by reducing the length of the gas nozzle 3 the distance of being weighed down due to its own weight is reduced. In a packaging apparatus adopting the above configuration, the front end portion of the gas nozzle 3 cannot be arranged adjacent to the top sealing device 4. In this case, the front end portion of the gas nozzle 3 is arranged upstream and relatively away from a front end portion of the tubular film 2. As a result, as the replacement ratio of air and gas becomes worse, greater amount of gas is needed to fill the front end portion of the tubular film 2 with a sufficient amount of gas.

Solution to Problem

In order to solve the problem, there is provided (1) a packaging apparatus, which is provided with a transportation device configured to transport a product enclosed in a packaging film; an upper holding belt device disposed over the transportation device; a top sealing device arranged downstream of the transportation device, and configured to seal the packaging film in a direction intersecting with a advancing direction; and a gas supplying device configured to supply gas into an inner space formed in the packaging film which is transported by the transportation device. The gas supplying device has a gas nozzle disposed in an upper side of the inner space. The gas nozzle has a front end portion which corresponds to a free end and is located in the inner space, and a fixed rear end portion. The upper holding belt device has a magnetic force-generating member. The gas nozzle is provided with a magnetic site. The gas nozzle is drawn by exerting a magnetic force generated by the magnetic force-generating member on the magnetic site.

In a preferred embodiment, the magnetic force-generating member may be a permanent magnet, which can be simply constructed. The magnetic force-generating member is not limited to the permanent magnet. For example, an electromagnetic force may be used. In this case, magnetic force can be preferably adjusted.

The magnetic site may be formed over the whole permanent magnet or on a part of the permanent magnet. The magnetic site may be formed on a part of the gas nozzle in an either axial or circumferential direction. If the magnetic site is formed on a part of the gas nozzle along its axis, it may be preferably formed at a front end portion of the gas nozzle. The gas nozzle is supported or fixed at its one end portion (i.e., rear end portion), and the front end portion (i.e., the other end portion) of the gas nozzle thus corresponds to a free end. The front end portion (i.e., the free end) of the gas nozzle has a tendency to be weighed down due to its own weight. Accordingly, the magnetic site is disposed at the front end portion of the gas nozzle, and the gas nozzle can be thus effectively drawn.

The front end portion of the gas nozzle is not limited to a leading edge of the gas nozzle, and should be understood that it is a relative concept with respect to a rear end portion which is supported or fixed. Accordingly, the present invention includes a case where the magnetic site is disposed at not an outermost end (i.e., a leading edge) but a location spaced from the outermost end. Furthermore, the magnetic site may be disposed at the center or rear portion of the gas nozzle regardless of whether the front end portion is formed.

The magnetic site may be formed over the whole circumference or a part of the circumference. If the gas nozzle is formed of magnetic material, as described in the following item (2), the magnetic site can be formed over the whole circumference of the gas nozzle. On the other hand, if a magnetic body is attached to the gas nozzle, as described in the following item (3), for example, an endless member may be employed, and the magnetic site may be formed over the whole circumference or a part of the circumference. In some cases where the magnetic site is formed on at least upper surface (i.e., top surface) of the gas nozzle, it is susceptible to magnetic attraction of the magnetic force-generating member.

In accordance with the present invention, the magnetic force generated from the magnetic force-generating member is exerted on the magnetic site, not only the magnetic site but also the gas nozzle having the free end are drawn. Due to this, the distance of the gas nozzle being weighed down due to its own weight can be considerably suppressed. In the present invention, it will be enough that the distance of the gas nozzle being weighed down due to its own weight can be reduced. Accordingly, it should be understood that the gas nozzle disposed in a horizontal state or rendering the front end portion raised is not essential. In order to securely prevent contact between the gas nozzle and the product, the magnetic force generated from the upper holding belt device may be increased, thereby rendering the gas nozzle horizontal or raised.

(2) Preferably, the gas nozzle is formed of magnetic material, and the magnetic material forms the magnetic site. As the gas nozzle itself is formed of magnetic material, the magnetic site can be easily or simply formed. As the magnetic site can be formed over a relatively large area, the gas nozzle can be drawn as a whole by the magnetic force.

(3) Preferably, a magnetic body is attached to the gas nozzle, and the magnetic body forms the magnetic site.

(4) Preferably, a slippery coating is applied onto a surface of the gas nozzle. In this case, even if the gas nozzle contacts a packaging film, little contact resistance would occur between the gas nozzle and the packaging film, thereby protecting the packaging film from damage caused by the gas nozzle. The coating can be formed by, for example, non-electrolytic plating.

(5) Preferably, the upper holding belt device has a timing belt, and a permanent magnet as the magnetic force-generating member is attached to a tooth section of the timing belt. By adopting the above configuration, as the tooth section inwardly projects and has a certain thickness, the permanent magnet can be securely attached to the tooth section. Furthermore, when the timing belt rotates around the pulley over which the timing belt is stretched, a smooth rotation of the timing belt can be obtained without the risk of contact between the permanent magnet and the pulley.

(6) Preferably, the upper holding belt device has a belt member comprising a permanent magnet as the magnetic force-generating member. For example, the belt member may be formed of a magnet sheet, a magnet resin, a magnet plate, and etc.

(7) Preferably, the gas nozzle drawn by the magnetic force generated by the upper holding belt device is horizontally arranged. By adopting the above configuration, contact between the gas nozzle and the product can be suppressed, and contact between the gas nozzle and the packaging film at a greater contact pressure can be considerably suppressed.

(8) Preferably, an opening for supplying gas into the inner space is provided on the front surface of the tip of the gas nozzle, and injection nozzles for injecting gas toward the packaging film are provided at an upper portion of the tip side of the gas nozzle. In this way, gas is injected from the injection nozzles toward the tubular film. The injected gas strikes the opposing packaging film, and upwardly biases the portion of the film that was hit. As a result, the portion of the film that was hit tends to float upward, and the frictional resistance between the gas nozzle and the packaging film is able to be reduced.

In addition, according to each of the above-described inventions, the front, free end portion of the gas nozzle is attracted by the magnetic force generated by the magnetic force-generating member and moves upward. If the magnetic force is large, the packaging film becomes strongly compressed between the gas nozzle and the upper holding belt device, preventing the smooth conveyance of the packaging film and causing scratches to occur on the packaging film. Therefore, providing mechanisms and functions that reduce the frictional resistance between the packaging film and the gas nozzle is preferable. Some examples showing this specific configuration of mechanisms and functions can be found in the above embodiments in (4) and (8).

Advantageous Effect of Invention

In accordance with the present invention, a distance of a front, free end portion of the gas nozzle being weighed down due to its own weight is alleviated or eliminated, thereby suppressing contact between the front end portion of the gas nozzle and the product.

BRIEF DESCRIPTION OF DRAWINGS

FIG. 3(*b*) is an enlarged view of a section B in FIG. 3(*a*); and FIG. 3(*c*) is a cross-sectional view of FIG. 3(*a*) along the line c-c.

DESCRIPTION OF EMBODIMENTS

Referring to the accompanying drawings, one embodiment of the present invention will be hereinafter described in detail. In addition, the present invention is not limited to this embodiment, and it should be appreciated that many equivalents, alternatives, variations, and modifications, aside from those expressly stated, are possible and within the scope of the invention.

Figure 2:
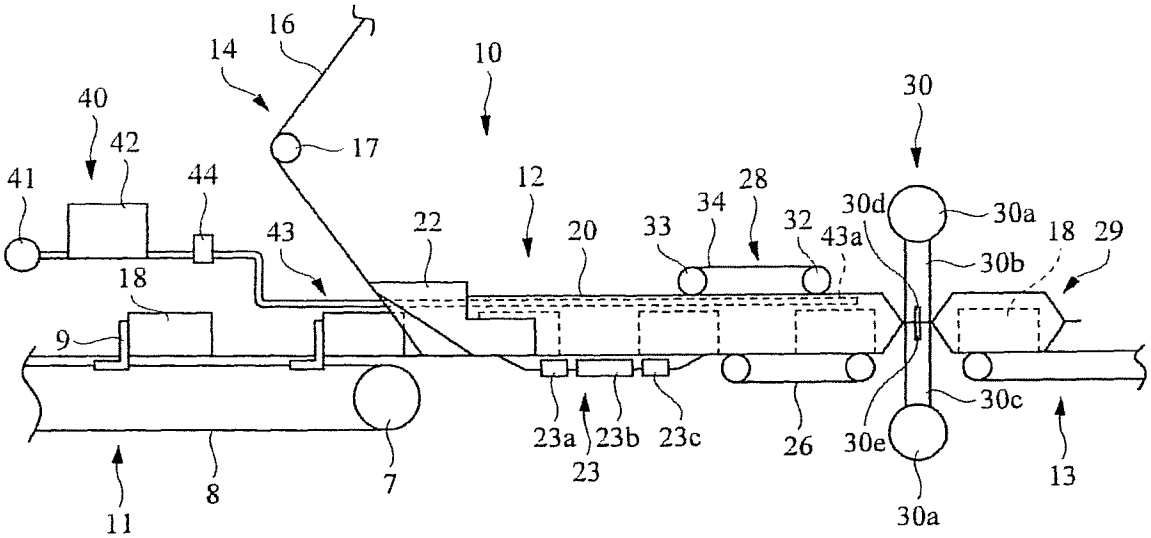
FIG. 2 is a front view of a preferred embodiment of a packaging apparatus in accordance with the present invention.
Figure 3:
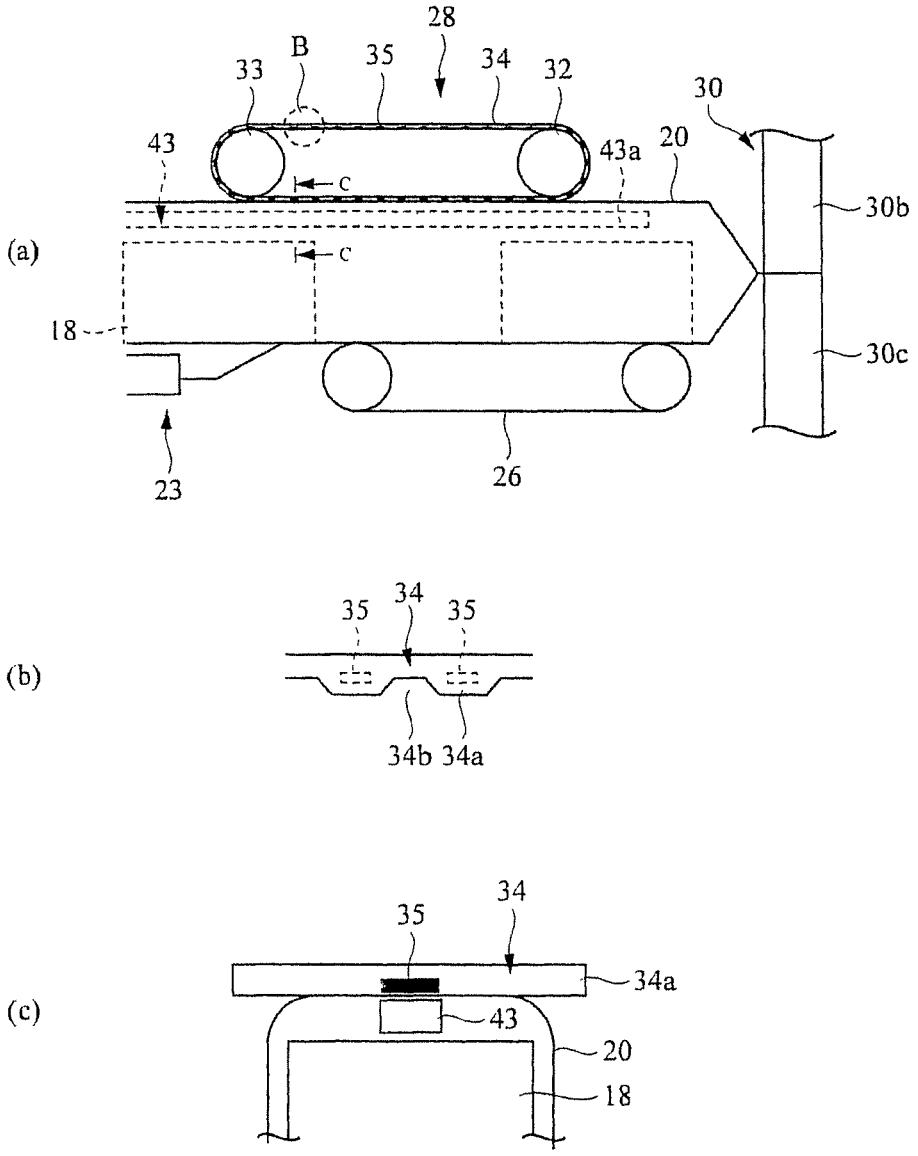
FIG. 3(*a*) is a partial enlarged front view of FIG. 2.

FIG. 2 and FIG. 3 show an example of a pillow packaging apparatus which is a preferred embodiment of the packaging apparatus in accordance with the present invention. A pillow packaging apparatus 10 is provided with a transporting and feeding device 11, a main body 12 and a taking-out conveyor 13 in an order from upstream side to downstream side. Over the transporting and feeding device 11, the main body 12 and the taking-out conveyor 13, a film supplying device 14 is arranged.

Figure 1:
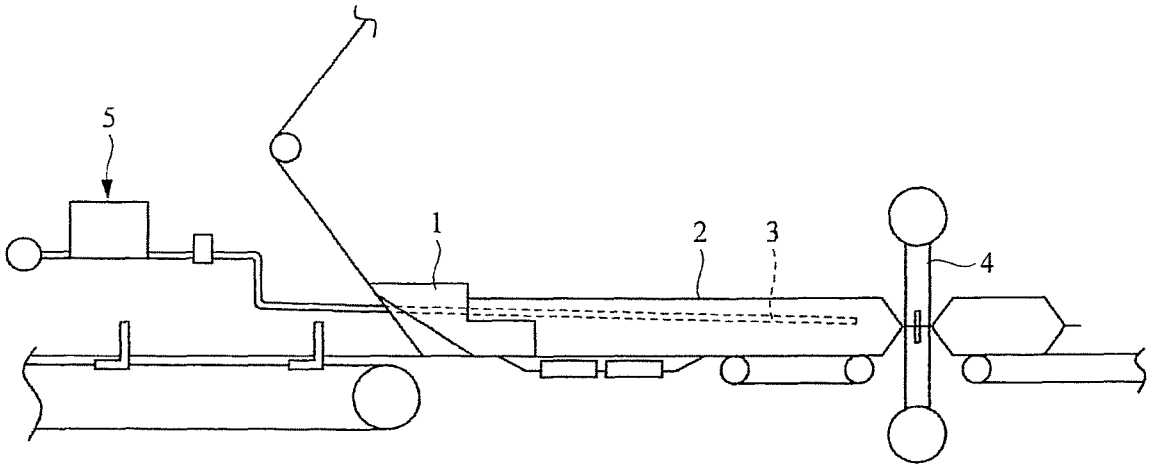
FIG.1 prior art
FIG. 1 shows a conventional packaging apparatus.

The transporting and feeding device 11 is provided with a finger conveyor which transports a product 18 at a constant interval and sequentially supplies the product 18 into the main body 12 for subsequent process or step. In other words, an press feed finger 9 is attached or coupled to an endless chain 8 at a constant interval. In this configuration, the endless chain 8 is stretched between the sprockets 7 (only downstream sprocket is shown in FIG. 1.) which are arranged anteroposteriorly. The product 18 is supplied between a previous or front press feed finger 9 and a next or rear press feed finger 9, thereby transporting the product 18 in a pitch (i.e., finger pitch) of the press feed finger 9.

The film supplying device 14 is configured to continuously supply a belt-like film 16, which is to be a packaging film for enclosing the product 18 therein, to the main body 12. The film supplying device 14 is provided with a member for supporting an original film roll (not shown) around which the belt-like film 16 is wound. The film supplying device 14 is provided with a roller 17 (one representative roller 17 is shown in FIG. 1.) configured to transport the belt-like film 16 continuously sent out from the original film roll along a predetermined transportation path to an inlet of the main body 12. The roller 17 include, but is not limited to, a driving roller for driving the belt-like film 16, a tension roller for applying a tension to the belt-like film 16, or a free roller to change the transportation direction of the belt-like film 16 and/or guide the transportation of the belt-like film 16.

The main body 12 is provided with a bag-making device 22 at the inlet thereof. The bag-making device 22 is configured to form the belt-like film 16 supplied from the film supplying device 14 into a tubular shape. In this configuration, as the belt-like film 16 passes the bag-making device 22, both side edges of the belt-like film 16 downwardly overlap to form a tubular film 20.

On the other hand, the products 18 sequentially taken out from the transporting and supplying device 11 are supplied into the bag-making device 22. Due to the configuration, the products 18 are supplied at a predetermined interval into the belt-like film 16. After that, the product 18 together with the tubular film 20 enclosing the product 18 therein is transported.

The main body 12 is further provided with a center sealing device 23 which is arranged downstream of the bag-making device 22. The center sealing device 23 seals the overlapping portions of the both side edges of the tubular film 20 which is obtained by passing the bag-making device 22. The center sealing device 23 is provided with a pair of pinch rollers 23*a* nipping the overlapping portions of the both side edges of the tubular film 20 to deliver transportation force, a pair of rod-shaped center sealers 23*b* nipping and heating the overlapping portions at both sides, and a pair of pressing rollers 23*c* arranged downstream of the center sealers 23*b* and applying a pressure to and cooling the heated and molten overlapping portions of the both side edges of the tubular film 20 to complete thermal sealing. While the embodiment employs a rod-shaped center sealer 23*b*, a variety of center sealers including a pair of rotating rollers may be employed as the center sealer 23*b*.

The main body 12 is provided with a lower belt conveyor device 26 and an upper holding belt device 28. The lower belt conveyor device 26 and the upper holding belt device 28 are arranged downstream of the center sealing device 23. The lower belt conveyor device 26 may be a transportation path for the tubular film 20 enclosing the product 18 therein. The upper holding belt device 28 is arranged at a predetermined location over the lower belt conveyor device 26. The upper holding belt device 28 is provided with a driving pulley 32, a driven pulley 33, and an endless belt 34 stretched between the driving pulley 32 and the driven pulley 33. The driving pulley 32 and the driven pulley 33 are anteroposteriorly arranged. The endless belt 34 can move up and down together with the pulleys, and is thus controlled such that it comes in contact with or approaches the tubular film 20. The driving pulley 32 is coordinated with a driving motor not shown in the figure, and rotated due to rotational force of the driving motor. As the driving pulley 32 rotates, the endless belt 34 rotates. Furthermore, the moving speed of the endless belt 34 within a section where the endless belt 34 horizontally moves is controlled to be equal to the moving speed of the tubular film 20. As such, the upper holding belt device 28 suppresses the floating or uplifting of the product 18.

The main body 12 is further provided with a top sealing device 30, which is arranged downstream of the lower belt conveyor device 26 and the upper holding belt device 28. The top sealing device 30 is provided with a pair of upper and lower rotational shafts 30*a*, an upper top sealer 30*b* coupled to the upper rotational shaft 30*a*, and a lower top sealer 30*c* coupled to the lower rotational shaft 30*a*. The upper rotational shaft 30*a* is disposed over the tubular film 20 and the lower rotational shaft 30*a* is disposed under the tubular film 20. The upper rotational shaft 30*a* is vertically opposed to the lower rotational shaft 30*a*. The tubular film 20 is disposed between the upper rotational shaft 30*a* and the lower rotational shaft 30*a*. Each of the upper top sealer 30*b* and the lower top sealer 30*c* is provided with a heater housed therein. Accordingly, a front sealing surface of the sealer is heated to a predetermined temperature. Moreover, the upper top sealer 30*b* is provided with a cutter edge 30*d* housed at a center portion of the sealing surface in an anterioposterior direction of the sealing surface. The lower top sealer 30*c* is also provided with a corresponding edge 30*e* housed at a center portion of the sealing surface in an anteroposterior direction of the sealing surface. Not only the upper and lower rotational shafts 30*a*, but also the upper top sealer 30*b* and the lower top sealer 30*c* rotate in synchronization with each other. The sealing surface of the upper top sealer 30*b* and the sealing surface of the lower top sealer 30*c* come in contact with each other with every rotation. Accordingly, while the sealing surface of the upper top sealer 30*b* and the sealing surface of the lower top sealer 30*c* are in contact with each other, the tubular film 20 is nipped by the upper top sealer 30*b* and the lower top sealer 30*c*, thereby being heated and pressurized. Furthermore, while the sealing surface of the upper top sealer 30*b* and the sealing surface of the lower top sealer 30*c* are in contact with each other, the cutting edge 30*d* and the corresponding edge 30*e* cooperatively cut the tubular film 20. As such, the top sealing device 30 can laterally seal and cut the tubular film 20, the center portion of which has been sealed, at a predetermined location where the product 18 is absent. Due to this, the tip or front end portion of the tubular film 20 (i.e. a portion enclosing a leading or previous product 18 therein) is separated from the tubular film 20 to form a packaged body 29. The packaged body 29 as thus obtained is transported on the taking-out conveyor device 13.

The pillow packaging apparatus 10 is further provided with a gas supplying device 40, which is configured to supply a predetermined gas into the tubular film 20. The gas supplying device 40 is provided with a gas tank 41, a mixing device 42 connected to the gas tank 41, and a gas nozzle 43 connected to the gas mixing device 42. One end of the gas nozzle 43 is supported or fixed, and the other end (i.e., an opposite end) of the gas nozzle 43 is a free end. The gas nozzle 43 passes through an upper portion inside the bag-making device 22 to be inserted into the tubular film 20, and is disposed such that a tip or front end portion (i.e., free end) 43*a* of the gas nozzle 43 lies adjacent to the top sealing device 30. The gas nozzle 43 is disposed in the center or middle portion of the bag-making device 22 and the tubular film 20 in an across-the-width direction. Then, the gas supplied from the gas tank 41 is injected from the front opening of the tip of the gas nozzle 43. Due to this, gas is ejected from the upper and center location within the tubular film 20. The gas nozzle 43 is further provided with a switching valve (i.e., change valve) 44 to switch on or off the gas ejection, and control flow rate.

The gas tank 41 is filled with gas to be supplied into the tubular film 20. In the embodiment, the gas is inert gas such as $N_2$ gas and $CO_2$. In the embodiment, as the gas supplying device 40 has the gas mixing device 42, a plurality of the gas tanks 41 are provided, the gases supplied by the plurality of the gas tanks 41 are mixed, and mixed gas is ejected. The gas mixing device 42 is not an essential element, and may be thus provided in needed. A control of the gas to be ejected into the tubular film 20 may be performed intermittently or continuously, as described in Patent Document 1.

In the embodiment, upward force originated from magnetic force is exerted on the tip or front end portion 43*a* of the gas nozzle 43, thereby inhibiting the front end portion 43*a* (the free end) from being weighed down. More specifically, a permanent magnet 35 is coupled or attached to the endless belt 34 of the upper holding belt device 28. The gas nozzle 43 is formed of magnetic material, and is drawn closer to the endless belt 34 due to magnetic force generated from the permanent magnet 35.

The magnetic material being capable of forming the gas nozzle 43 may a soft magnetic material or a hard magnetic material. As the permanent magnet 35 is disposed at the endless belt 34, the gas nozzle 43 itself does not need to generate magnetic force. For the above reason, the hard magnetic material may or may not be employed as the magnetic material for the gas nozzle 43. The gas nozzle 43 is elongated. The gas nozzle 43 needs a certain level of strength and is preferably formed of material which is easy to form such an elongated shape. In view of the above, the soft magnetic material may be employed as the magnetic material for the gas nozzle 43. In the embodiment, iron (steel) is employed.

The gas nozzle 43 has a flat, approximately rectangular longitudinal section. As the top surface of the gas nozzle 43 is flat, both sides of the top surface are closer to the permanent magnet 35. For the above configuration, the gas nozzle 43 is more securely drawn due to the magnetic force. In terms of magnetic force (i.e., attraction), the gas nozzle 43 is preferably made flat and thin. For more detail, the thin gas nozzle 43 is preferred in terms of weight and the flat gas nozzle 43 is preferred in terms of width.

A slippery coating layer may be formed on the surface of the gas nozzle 43. Due to the coating layer, even if the gas nozzle 43 is in contact with the tubular film 20, the tubular film 20 is prevented from damage caused by the gas nozzle 43. In the embodiment, the coating layer is formed by non-electrolytic plating. Due to this, an even coating layer can be advantageously formed on the surface of the gas nozzle 43.

The endless belt 34 may be a timing belt. In this case, the driving pulley 32 and the driven pulley 33 are stepped pulleys. The timing belt is provided with a tooth section 34*a* extending in its across-the-width direction on inner periphery thereof. The tooth sections 34*a* are arranged at a predetermined pitch in a circumferential direction. A groove 34*b* formed between the neighboring tooth sections 34*a* is put around the tooth section formed in the driving pulley 32 and/or the driven pulley 33. The tooth section 34*a* may have a trapezoidal or rectangular cross-section, and has a certain thickness. In this regard, the permanent magnet 35 is embedded in, for example, the center portion of the tooth section 34*a* in the cross-the-width direction of the tooth section 34*a*. Prior to the embedding, a part of the center portion of the tooth section 34*a* may be removed, and the permanent magnet 35 may be disposed in the removed portion of the tooth section 34*a*. As this type of timing belt is formed of, for example, a rubber, and etc., the shape and dimension of the removed portion may be identical or less than the shape and dimension of the permanent magnet 35. In this case, the permanent magnet 35 inserted in the removed portion may be easily retained due to elastic properties of the rubber used. Furthermore, if the permanent magnet 35 is securely fixed by an adhesive or other means, the permanent magnet 35 in operation can be prevented from coming off or separation. After inserting the permanent magnet 35 in the removed portion, a filling member (i.e., blocking member) may be disposed in the remaining removed portion to enclose the permanent magnet 35 in the removed portion. By adopting the above configuration, the permanent magnet 35 in operation can be securely prevented from coming off or separation. The filling member (i.e., blocking member) may be preferably a material which becomes solidified or hardened after filling viscous filler such as a rubber, a resin and other solid material, and coking material.

The permanent magnet 35 may be disposed in all the tooth sections 34*a*, or a part of tooth sections 34*a*. In order to obtain greater magnetic force, the permanent magnet 35 is preferably disposed in all the tooth sections 34*a*. The permanent magnet 35 having great magnetic force, for example, a neodymium magnet can be preferably employed. As the permanent magnet 35 is disposed at the endless belt 34, its size should be made relatively small. In this regard, the magnet having a smaller size and greater magnetic force, for example, neodymium magnet can be advantageously used. However, the magnet which can be employed in the present invention is not limited to the neodymium magnet, and a variety of magnet may be employed as the permanent magnet 35 of the present invention.

In the above embodiment, the permanent magnets 35 are circumferentially scattered at the center portion of the endless belt 34 of the upper holding belt device 28 in the cross-the-width direction of the endless belt 34. The gas nozzle 43 which is inserted into the tubular film 20 is disposed under the permanent magnet 35. For the above configuration, the gas nozzle 43 is subjected to upward biasing force generated by the permanent magnet 35 and the tendency of the front end portion (i.e., free end) 43*a* of the gas nozzle 43 to be weighed down for its own weight can be suppressed. In other words, the distance of the front end portion 43*a* of the gas nozzle 43 being weighed down is suppressed. As a result, the front end portion 43*a* of the gas nozzle 43 is protected from contacting the product 18. In this case, the permanent magnet 35 is disposed such that the gas nozzle 43 is continuously subjected to upward biasing force, thereby suppressing vertical oscillation or floating of the gas nozzle 43.

In the embodiment, multiple permanent magnets 35 each having greater magnet force are used to increase magnetic force generated by the overall endless belt 34. In addition, the permanent magnets 35 are disposed at a predetermined pitch over the whole circumference of the endless belt 34, thereby drawing the relatively long overall area of the gas nozzle 43, as well as, reducing an amount of the front end portion 43*a* to be weighed down. When the biasing force of the permanent magnet 35 exerted on the gas nozzle 43 is greater than downward force of the front end portion 43*a* of the gas nozzle 43 being weighed down for its own weight, the free front end portion 43*a* becomes upwardly raised relative to the horizontal state. Due to this, the front end portion 43*a* of the gas nozzle 43 is securely prevented from contacting the product 18.

The biasing force of the permanent magnet 35 exerted on the gas nozzle 43 and the force of the front end portion 43*a* of the gas nozzle 43 being weighed down for its own weight can be balanced by properly controlling the shape and dimension (i.e., size) of the permanent magnet 35, the number used of the permanent magnet 35, and material for the permanent magnet. In a preferred embodiment, the front end portion 43*a* of the gas nozzle 43 may be substantially horizontally arranged. As such configuration is employed, the front end portion 43*a* of the gas nozzle 43 does not come in contact with the tubular film 20. In other words, the front end portion 43*a* of the gas nozzle 43 hangs in the air. As a result, the front end portion 43*a* of the gas nozzle 43 is advantageously prevented from contacting the product 18.

If the magnetic force generated by the permanent magnet 35 is large, the tubular film 20 becomes strongly compressed between the gas nozzle 43 and the upper holding belt device 8, preventing the smooth conveyance of the tubular film 20 and causing scratches to occur on the tubular film 20. In the present embodiment, because a coating layer is provided on the surface of the gas nozzle 43, the contact resistance generated between the gas nozzle 43 and the tubular film 20 is minimal, which allows for the tubular film 20 to be smoothly conveyed and minimizes the tubular film 20 from becoming scratched.

While in the afore-mentioned embodiment the timing belt is employed as the endless belt 34, the present invention is not limited to the afore-mentioned embodiment. For example, a flat belt, and etc. may be employed in the present invention. When the flat belt is employed, the permanent magnet may be attached or coupled to the center portion of the inner periphery of the flat belt in an across-the-width direction of the flat belt. The pulley over which the flat belt is stretched has a circumferentially extending (concave) groove at the center portion of the pulley in an across-the-width direction of the pulley. In this configuration, the permanent magnet moves into the groove, and the flat belt contacts both side edges of the pulley in which the groove is absent and receives the transportation force to be smoothly rotation driven. The groove is not essential to the pulley. For example, instead of the grove, there may be provided two pulleys which are coaxially arranged and spaced from each other. In this configuration, the both sides of the flat belt may contact the two pulleys respectively and receive transportation force from the pulleys, and the permanent magnet may be movable within space between the two pulleys.

While in the afore-mentioned embodiment and the modified embodiments the endless belt is employed as the belt member, a plurality of band plates may be aligned in parallel to form the belt member. Such a belt member includes, for example, a plate conveyor. In this type of belt member, as individual band plates is an element of the belt member, the permanent magnet is easy to attach to the belt member (in particular, the band plate). Furthermore, the permanent magnet hardly disrupts the movement of the belt member around a member forming endless orbital or path, such as a pulley and sprocket.

While in the afore-mentioned embodiment and the modified embodiments the permanent magnet is attached or coupled to the belt, the present invention is not limited to the afore-mentioned embodiment and the modified embodiments. In other words, the belt itself may be formed of magnet. In this case, it is advantageous that the belt can generate magnetic force as a whole.

In the afore-mentioned embodiment and the modified embodiments, the gas nozzle 43 has the flat, rectangular longitudinal section. However, the gas nozzle 43 may have any other shape, for example, a round longitudinal section.

While in the afore-mentioned embodiment and the modified embodiments, the permanent magnet is attached or coupled to the belt member, the present invention is not limited to the afore-mentioned embodiment and the modified embodiments. For example, the pulley or other member may be provided with the magnetic force-generating member, and the magnetic force generated by the magnetic force-generating member may transmit or permeate the belt member, and is exerted on the magnetic site of the gas nozzle. Furthermore, the inventive magnetic force-generating member is not limited to the permanent magnet. An electromagnet may be used as the magnetic force-generating member. The electromagnet is preferred in that it can easily generates great magnetic force in comparison to the permanent magnet, and the magnetic force can be adjusted.

Figure 4:
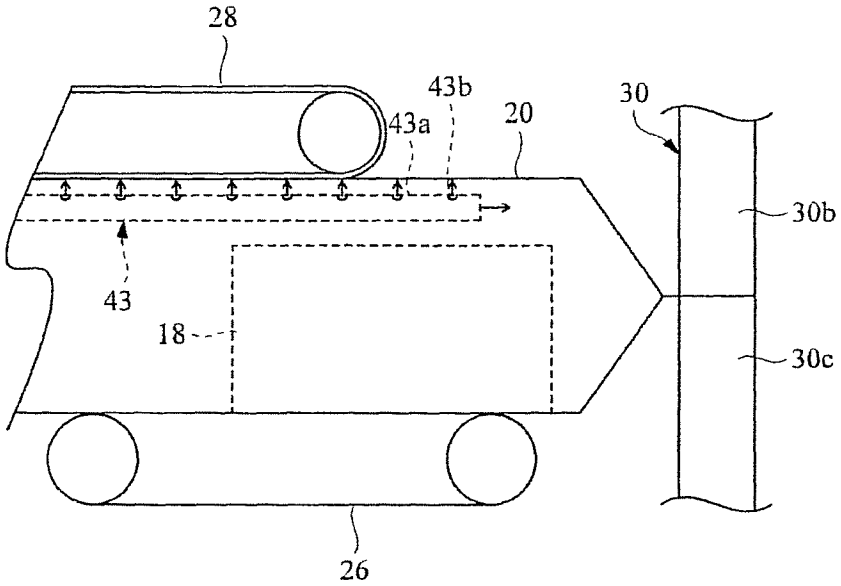
FIG. 4 is a front view showing a modified example of the packaging apparatus in accordance with the present invention.

Based on the above-described embodiments and modifications, providing a gas injection port on the upper surface side of the gas nozzle is preferable. For example, FIG. 4 shows an essential part of the modification in that injection nozzles 43*b* are provided in the gas nozzle 43. In the gas nozzle 43 of this modified example, a cylindrical pipe having a vertical cross-sectional shape is used. The injection nozzles 43*b* are provided on the upper surface if the gas nozzle which is in contact with or facing the tubular film 20. A plurality of injection nozzles 43*b* are arranged in a row in the uppermost portion of the cylindrical gas nozzle 43 along the lengthwise direction of the gas nozzle 43. The inner diameter of each of the injection nozzles 43*b* is smaller than the inner diameter of the front opening of the tip of the gas nozzle 43. As a result, most of the gas supplied from the gas cylinder 41 is injected forward from the front opening of the tip, and is used to replace gas in the tubular film 20. A portion of the gas supplied from the gas cylinder 41 is injected upward from the injection nozzle 43*b*. The injected gas strikes the opposing tubular film 20 and urges the film portion upward. As a result, the film portion tends to float upward, and the frictional resistance between the gas nozzle 43 and the tubular film 20 is reduced. Then, the gas ejected from the injection nozzles 43*b* remains in the tubular film 20, while also functioning as a gas replacement in the tubular film 20.

The area where the injection nozzle 43*b* is provided is the front end portion 43*a* of the gas nozzle 43. Preferably, this area should be where the magnetic force attracting the gas nozzle 43 is generated. For example, the area may be set as the installation region of the upper holding belt device 28 which incorporates the permanent magnet 35. The injection nozzle may be provided on the upstream side of the region, but more preferably, the injection nozzle is not provided on the upstream side of the region. If the injection nozzle is provided on the upstream side and gas is injected from the injection nozzle, then efficiently filling the gas supplied from the gas cylinder 41 in the deep space of the tubular film 20 near the top sealing device 30 becomes difficult. Therefore, by disposing the injection nozzles 43*b* only in the tip portion 43*a* of the gas nozzle 43, the deep space of the tubular film 20 is able to be filled with gas.

Although the shape of the injection nozzles 43*b* of the present modification is circular, the present invention is not limited to this shape, and other shapes such as a rectangular shape, an elongated slit shape or other various kinds of small opening shapes extending in the lengthwise direction of the gas nozzle may also be used.

If the shape of the lengthwise section of the gas nozzle 43 is rectangular, then the the upper surface will have a predetermined width and will be flat. If the gas nozzle 43 has this shape, then the plurality of rows of injection nozzles 43*b* may be arranged, for example, on the upper surface along the lengthwise direction of the gas nozzle 43. Likewise, the injection nozzles 43*b* may also be arranged in a staggered manner.

While in the afore-mentioned embodiment and the modified embodiments, the center sealing device is disposed under the tubular film in the packaging apparatus, the present invention is not limited to the afore-mentioned embodiment and the modified embodiments. The belt-like film may be downwardly supplied to the bag-making device, and the both side edges of the belt-like film may overlap at an upper side. In this case, the center sealing device is disposed over the tubular film. This type of packaging apparatus is called as reverse pillow packaging apparatus.

In the above configuration, the gas nozzle may be displaced or shifted such that it does not overlap the center sealing portion sealed by the center sealing device. More specifically, the center sealing portion is folded and moved with overlapping the surface of the tubular film. If the gas nozzle is disposed at a location where the center sealing portion overlaps the surface of the tubular film, the center sealing portion and the tubular film are interposed between the gas nozzle and the permanent magnet. Accordingly, magnetic force cannot be efficiently exerted on the magnetic site. In view of the above, by arranging the gas nozzle such that the gas nozzle does not overlap the center sealing portion, efficient magnetic attraction can be achieved, as in the pillow packaging apparatus described previously.

The inventive packaging apparatus is not limited to the type of pillow packaging apparatus including the afore-mentioned reverse pillow packaging apparatus. For example, the present invention may be applied to other types of packaging apparatus including a three-way packaging apparatus in which the belt-like film is centrally folded to laterally form an approximately horseshoe shape, a film portion located at one side edge in an advancing direction is sealed, and a location between the previous product and the next product is laterally cut and sealed.

The afore-mentioned embodiment and modified embodiments may be properly practiced in combination with each other. Furthermore, a part or element of the embodiment or the modified embodiments may be properly combined with a part or element of other embodiment or the modified embodiments. The inventions as defined in the following claims may be properly combined with each other. For example, the configuration in which a slippery coating is applied to the surface of the gas nozzle may be combined with the inventions described in the other claims. Similarly, for example, the configuration in which the upper holding belt device has a timing belt and the permanent magnet as the magnetic force-generating member is attached to a tooth section of the timing belt may be combined with the inventions described in the other claims.

REFERENCE SIGN LIST

10 pillow packaging machine
11 transporting and feeding device
12 main body
13 taking-out conveyor
14 film supplying device
16 belt-like film
18 product
20 tubular film
22 bag-making device
23 center sealing device
26 lower belt conveyor device (transportation device)
28 upper holding belt device
30 top sealing device
32 driving pulley
33 driven pulley
34 endless belt
34*a* tooth section
35 permanent magnet
43 gas nozzle
43*a* front end portion (tip portion) of gas nozzle
43*b* injection nozzles

The invention claimed is:

1. A packaging apparatus, comprising:

a transportation device configured to transport a product enclosed in a packaging film;

an upper holding belt device disposed over the transportation device;

a top sealing device arranged downstream of the transportation device, and configured to seal the packaging film in a direction intersecting with a advancing direction; and a gas supplying device configured to supply gas into an inner space formed in the packaging film which is transported by the transportation device, the gas supplying device having a gas nozzle disposed in an upper side of the inner space, the gas nozzle having a front end portion which corresponds to a free end and is located in the inner space, and a fixed rear end portion, wherein the upper holding belt device has a magnetic force-generating member, wherein the gas nozzle is provided with a magnetic site, and wherein the gas nozzle is drawn by exerting a magnetic force generated by the magnetic force-generating member on the magnetic site.

2. The packaging apparatus according to claim 1, wherein the gas nozzle is formed of magnetic material, and the magnetic material forms the magnetic site.

3. The packaging apparatus according to claim 1, wherein a magnetic body is attached to the gas nozzle, and the magnetic body forms the magnetic site.

4. The packaging apparatus according to claim 1, wherein a slippery coating is applied onto a surface of the gas nozzle.

5. The packaging apparatus according to claim 1, wherein the upper holding belt device has a timing belt, and wherein a permanent magnet as the magnetic force-generating member is attached to a tooth section of the timing belt.

6. The packaging apparatus according to claim 1, wherein the upper holding belt device has a belt member comprising a permanent magnet as the magnetic force-generating member.

7. The packaging apparatus according to claim 1, wherein the gas nozzle drawn by the magnetic force generated by the upper holding belt device is horizontally arranged.

8. The packaging apparatus according to claim 1, wherein an opening for supplying gas into the inner space is provided on the front surface of the tip of the gas nozzle, and injection nozzles for injecting gas toward the packaging film are provided at an upper portion of the tip side of the gas nozzle.

* * * * *